US007972063B1

(12) United States Patent
Barsalou

(10) Patent No.: US 7,972,063 B1
(45) Date of Patent: Jul. 5, 2011

(54) INFLATABLE BEVERAGE INSULATOR

(75) Inventor: Mark A. Barsalou, San Antonio, TX (US)

(73) Assignee: Quarter Moon Properties, LLC, San Antonio, TX (US)

( * ) Notice: Subject to any disclaimer, the term of this patent is extended or adjusted under 35 U.S.C. 154(b) by 1171 days.

(21) Appl. No.: 11/708,689

(22) Filed: Feb. 20, 2007

(51) Int. Cl.

| | |
|---|---|
| ***A47J 39/00*** | (2006.01) |
| ***B65D 30/00*** | (2006.01) |
| ***B65D 30/08*** | (2006.01) |
| ***B65D 25/00*** | (2006.01) |
| ***B65D 81/02*** | (2006.01) |
| ***B65D 85/00*** | (2006.01) |

(52) U.S. Cl. ..... 383/3; 383/110; 220/739; 220/592.16; 206/522

(58) Field of Classification Search ..... 383/3, 110; 220/739, 592.16; 206/522
See application file for complete search history.

(56) References Cited

U.S. PATENT DOCUMENTS

| | | | | | |
|---|---|---|---|---|---|
| 3,133,575 | A | * | 5/1964 | Slemmons | 206/568 |
| 3,151,650 | A | * | 10/1964 | Beck | 206/568 |
| 3,742,994 | A | * | 7/1973 | Pensak | 383/3 |
| 4,089,358 | A | * | 5/1978 | Korson | 229/400 |
| 4,546,900 | A | * | 10/1985 | Lackey | 220/592.16 |
| 4,705,085 | A | * | 11/1987 | Brown | 220/592.16 |
| 5,065,879 | A | | 11/1991 | King | |
| 5,135,132 | A | * | 8/1992 | Potochnik | 220/592.16 |
| 5,211,307 | A | * | 5/1993 | Jeffries | 220/739 |
| 5,259,529 | A | | 11/1993 | Coale | |
| 5,609,265 | A | | 3/1997 | Haberkorn et al. | |
| 5,622,261 | A | * | 4/1997 | Mobley et al. | 206/457 |
| 5,653,124 | A | | 8/1997 | Weber | |
| 5,845,806 | A | | 12/1998 | Parchman | |
| 5,909,821 | A | | 6/1999 | Guridi | |
| 6,123,217 | A | * | 9/2000 | Miller | 220/592.19 |
| 6,164,487 | A | | 12/2000 | Hicks | |
| 6,266,829 | B1 | * | 7/2001 | Schmidt | 4/258 |
| 6,410,065 | B1 | * | 6/2002 | Nottingham et al. | 426/87 |
| 6,530,232 | B1 | | 3/2003 | Kitchens | |
| 6,655,543 | B2 | | 12/2003 | Beuke | |
| 6,991,505 | B1 | | 1/2006 | Wells | |
| 7,168,567 | B2 | * | 1/2007 | Peper et al. | 206/522 |
| 7,290,679 | B2 | * | 11/2007 | Hechmati | 220/739 |
| 7,337,915 | B1 | * | 3/2008 | Weldon | 220/739 |
| 7,410,057 | B2 | * | 8/2008 | Yoshifusa | 206/522 |
| 2004/0084461 | A1 | * | 5/2004 | Eisenbraun et al. | 220/739 |
| 2004/0173625 | A1 | | 9/2004 | Jones | |
| 2004/0182870 | A1 | | 9/2004 | Rodgers | |
| 2004/0251262 | A1 | | 12/2004 | Hechmati | |

OTHER PUBLICATIONS

Coors Brewing Company Invoice (Invoice Date: Aug. 23, 2005).

* cited by examiner

*Primary Examiner* — Nathan J Newhouse
*Assistant Examiner* — Latrice Byrd
(74) *Attorney, Agent, or Firm* — Cox Smith Matthews Incorporated

(57) ABSTRACT

A beverage insulator as described herein may comprise a generally hollow body having an interior space, wherein the interior space is adaptable to receive at least a portion of a beverage container, and a compartment disposed exteriorly of and in fluid communication with the interior space. The interior space and the compartment may be in fluid communication with each other via a valve or other suitable conduit. The interior space may be sized and shaped complementary to a beverage container such that when the beverage container is inserted into the interior space, the compartment is inflated with air or other fluid. Alternatively, a valve may be configured to receive a tube through which a user may blow air or other fluid in order to inflate the compartment. The inflated compartment insulates the beverage container and its contents.

20 Claims, 7 Drawing Sheets

INFLATABLE BEVERAGE INSULATOR

FIELD

This application relates generally to beverage insulators.

BACKGROUND

Beverage containers such as cans and bottles frequently need to be kept either relatively hot or relatively cold to suit the preference of a user. Many users do not enjoy the taste of coffee or hot tea if these beverages become cold. A warm beverage container filled with coffee may become cold quickly due to winter temperatures. Conversely, many users do not enjoy the taste of soda, water, or fruit drinks when these beverages become warm or hot. During a hot summer day, a once cold beverage container filled with soda can become extremely warm in a matter of minutes. The taste of certain foods is dependent on whether these foods are a certain temperature. In addition, many beverages and foods must stay at a certain temperature to prevent the growth of bacteria or fungus. Foods and beverages contaminated with bacteria or fungus can pose a serious health risk. As such, the need exists to insulate beverage containers.

SUMMARY

A beverage insulator as described herein may comprise a generally hollow body having an interior space, wherein the interior space is adaptable to receive at least a portion of a beverage container, and a compartment disposed exteriorly of and in fluid communication with the interior space. The interior space and the compartment may be in fluid communication with each other via a valve or other suitable conduit. The interior space may be sized and shaped complementary to a beverage container such that when the beverage container is inserted into the interior space, the compartment is inflated with air or other fluid. Alternatively, a valve may be configured to receive a tube through which a user may blow air or other fluid in order to inflate the compartment. The inflated compartment insulates the beverage container and its contents.

DETAILED DESCRIPTION

Figure 1:
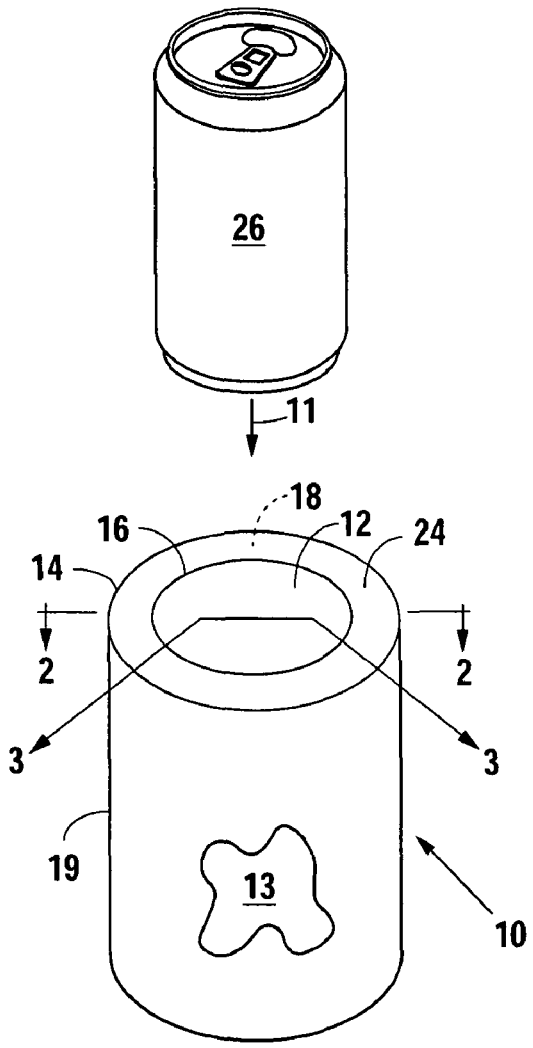
FIG. 1 is a perspective, partially exploded view of a beverage insulator as used in connection with a beverage container.

As used herein, the following terms should be understood to have the indicated meanings:

When an item is introduced by "a" or "an," it should be understood to mean one or more of that item.

"Affinity" means, with respect to two or more objects, an attraction between or among such objects that tends to cause such objects to be in proximity to each other. Such an affinity may be caused by the chemical composition, surface geometry, electrical charge, magnetism, or other attribute of the objects. Two or more objects that have an affinity for each other may or may not adhere to or become substantially attached to one another.

"Air" means one or more gases, including but not limited to atmospheric gases or any components or combinations thereof. Air may or may not contain liquid or solid particles therein.

"Beverage container" means a receptacle adaptable to contain one or more liquids, gases, solids, or a combination thereof. A beverage container may be made of any desired material and may have any desired shape, size, color, strength, stiffness, or other attribute.

"Compartment" means a substantially enclosed space.

"Compressed" means, with respect to an item, a physical state in which such item occupies less space than such item may occupy in another physical state.

"Comprises" means includes but is not limited to.

"Comprising" means including but not limited to.

"Decorative" means having an element of aesthetic design, ornamentation, embellishment, or other appearance designed to draw the attention of an observer when viewed.

"Flexible" means, with respect to an item, capable of being readily folded, bent, compressed, twisted, or a combination thereof without significantly compromising the structural integrity of such item as a result of such action.

"Fluid" means a liquid, gas, or combination thereof. A fluid may or may not have solid particles therein.

"Graphic element" means an alphanumeric, symbolic, textual, pictorial, sculptural, or other physical representation observable with the eye, or a combination thereof. A graphic element may be two-dimensional or three-dimensional; may be characterized by the presence or absence of material or a combination thereof; and may be made in any desired manner, including but not limited to printing, lithography, painting, staining, sculpting, embossing, or a combination thereof. A graphic element may have one or more natural components in lieu of, or in addition to, one or more manufactured components.

"Having" means including but not limited to.

"Impermeable" means, with respect to an item, that such item does not permit passage of one or more liquids, gases, or a combination thereof through the substance of such item.

"Insulate" means to prevent or hinder the transfer of heat. To insulate an object or region may or may not have the effect of substantially maintaining the temperature of such object or region over a period of time, whether such temperature is relatively hot or relatively cold with respect to one or more other objects or regions.

"Layer" means a piece of material that is substantially impermeable and has a thickness that is relatively small in comparison to its length, breadth, height, perimeter, circumference, or other dimension. A layer may be made of any desired material and may have any desired size, shape, color, or other attribute. A layer may or may not have a uniform thickness and may or may not be decorative.

"Periphery" means an external boundary of an object.

"Seal" means a structure that substantially closes an opening such that the opening becomes substantially impermeable.

"Seam" means, with respect to two objects, a substantially impermeable attachment of such objects to each other. A seam may be made in any desirable manner, including but not limited to attachment by glue, adhesive, stitches, staples, tape, hook and loop fasteners, or molding or melting of objects to form an attachment, or a combination thereof. A seam may or may not be located at or along the edges of two or more objects.

"Valve" means a device having a passageway through which the flow of one or more liquids, gases, or a combination thereof may be regulated by partially or completely obstructing such passageway. A valve may have any desired size, shape, or other attribute and may be made of any desired material. A valve may or may not be "one-way" such that it allows flow in substantially one direction only.

Figure 2:
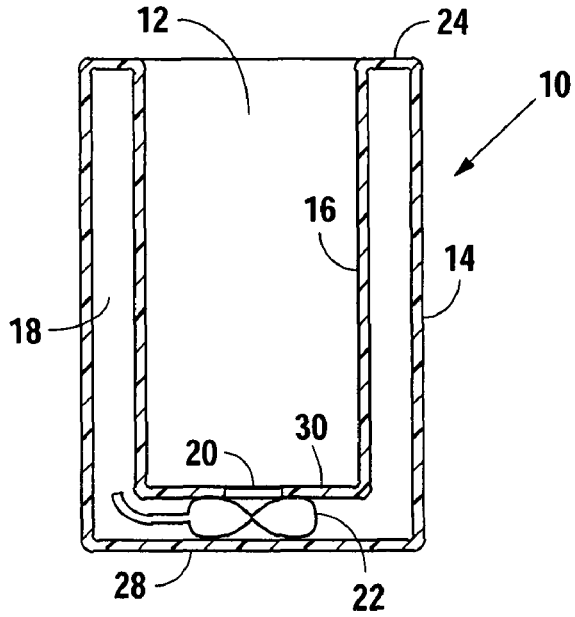
FIG. 2 is a sectional view of the beverage insulator of FIG. 1 taken along section 2-2 as shown in FIG. 1.
Figure 3:
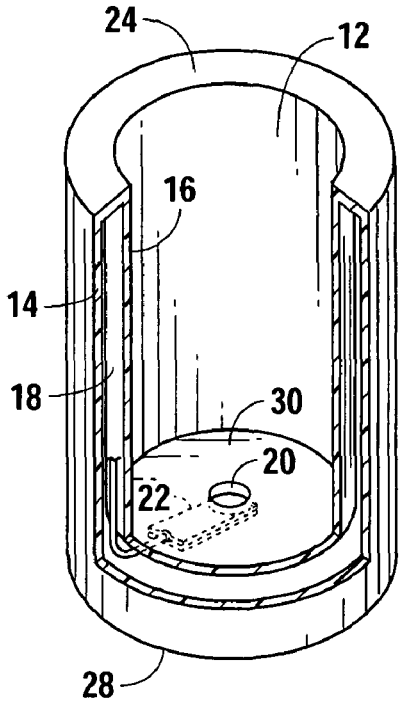
FIG. 3 is a perspective, partially sectional view of the beverage insulator of FIG. 1 taken along section 3-3 as shown in FIG. 1.
Figure 14:
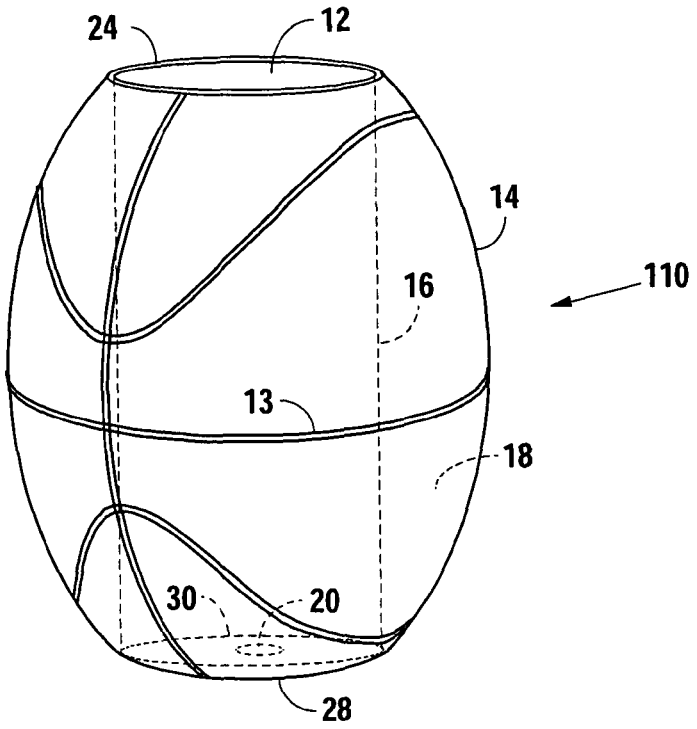
FIG. 14 is a perspective view of another embodiment of a beverage insulator.
Figure 15:
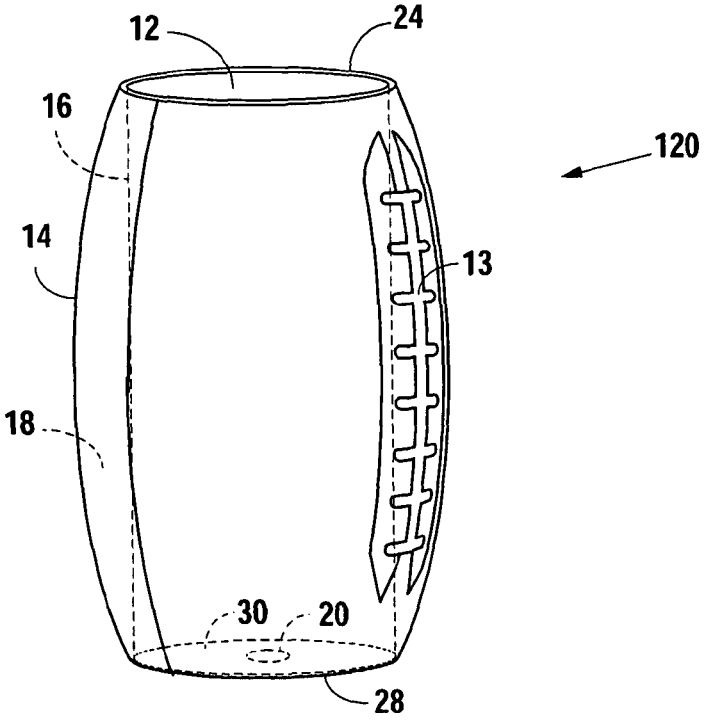
FIG. 15 is a perspective view of yet another embodiment of a beverage insulator.
Figure 17A:
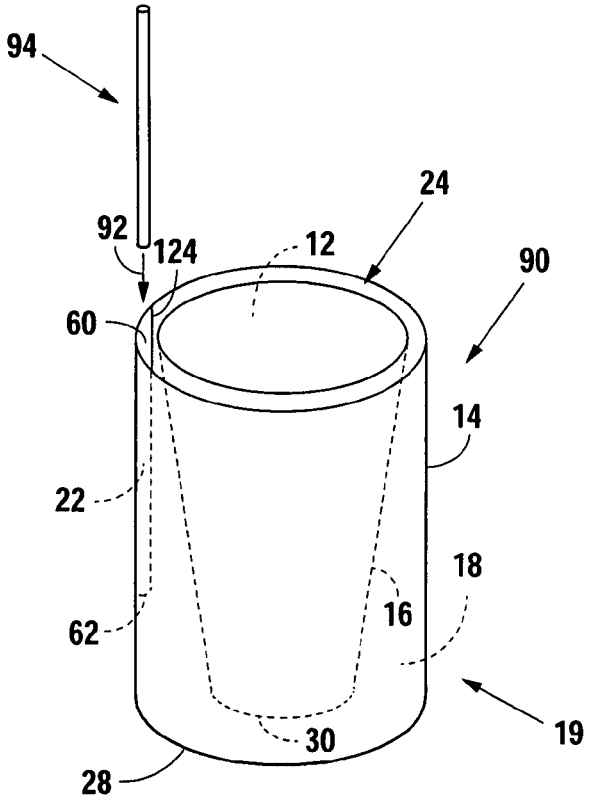
FIG. 17A is a perspective view of an embodiment of a beverage insulator as used in connection with a tube.

Referring to FIGS. 1-3, a beverage insulator 10 and a beverage container 26 are shown. Beverage insulator 10 may have a generally hollow body 19. Beverage insulator 10 may be constructed, sized, and shaped such that beverage container 26 fits into an interior space 12 of body 19 by sliding down into beverage insulator 10 as shown by arrow 11. Beverage container 26 may be readily removed from beverage insulator 10 by the reverse process. Hollow body 19 may comprise an inner layer 16 and an outer layer 14. In some embodiments, beverage insulator 10 may be sized such that beverage container 26 fits fairly snugly in space 12 and at least a portion of inner layer 16 may be in direct contact with at least a portion of beverage container 26. Beverage insulator 10 may have a compartment 18 adaptable to contain air or other gases, liquids, or a combination thereof. Although beverage insulator 10 is shown having one compartment 18, beverage insulator 10 may have two or more compartments 18, which may or may not be in fluid communication with each other. As described further below, air or other fluid in compartment 18 may insulate beverage container 26. Although certain embodiments illustrated herein show beverage insulator 10 and beverage container 26 as cylindrical, beverage insulator 10 may be designed to complement and receive a variety of beverage containers 26, the cross sectional shapes of which may be square, rectangular, oval, triangular, irregular, or any other desired shape. In some embodiments illustrated herein, inner layer 16 and outer layer 14 may have substantially similar shapes. In other embodiments, such as illustrated in FIGS. 14-15 and FIG. 17A, outer layer 14 may have a shape that is at least partially different from the shape of inner layer 16. For example, but without limitation, inner layer 16 may be designed to complement a substantially cylindrical beverage container 26, while outer layer 14 may have a substantially convex shape as shown in FIGS. 14-15. Alternatively, as shown in FIG. 17A, inner layer 16 may be designed to complement an at least partially conical beverage container 26, such as a typical coffee cup, for example, while outer layer 14 may have a substantially cylindrical shape. If desired, either or both of inner layer 16 and outer layer 14 of beverage insulator 10 may have one or more decorative graphic elements 13 thereon, which may be customized in any desired manner. For example, graphic element 13 may comprise one or more sports team logos, branding elements, advertising, or any other desired features. Alternatively, beverage insulator 10 may be customized to have an appearance that is substantially similar to a basketball or football, or any other desired object, by use of a suitable graphic element 13, a suitable shape of outer layer 14, or a combination thereof as shown in FIGS. 14-15.

Figure 9:
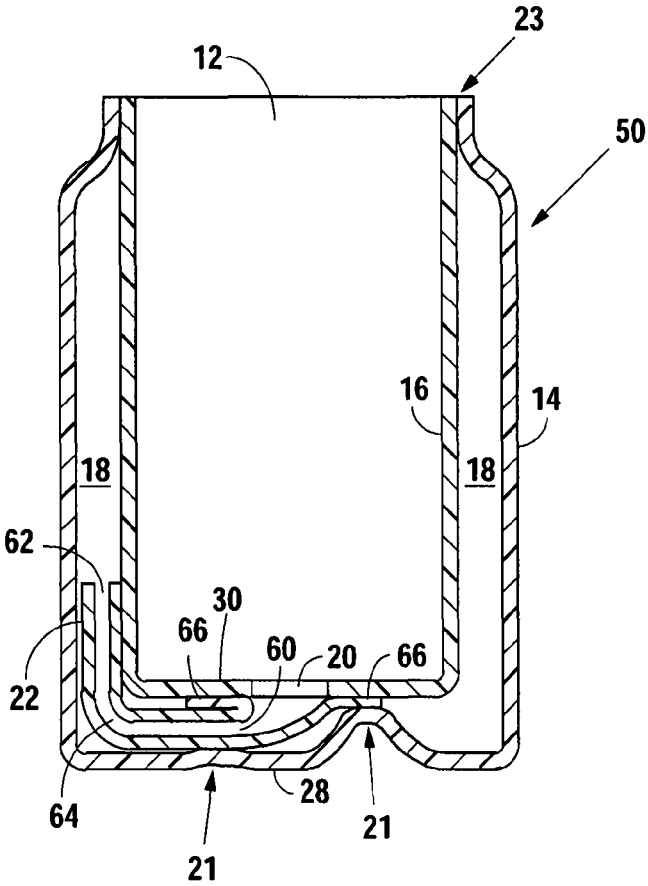
FIG. 9 is a sectional view of another embodiment of a beverage insulator.

Still referring to FIGS. 1-3, beverage insulator 10 is shown having compartment 18 located along the periphery of beverage insulator 10. Compartment 18 may be formed by inner layer 16 and outer layer 14 such that there is at least some space between inner layer 16 and outer layer 14. In some embodiments, an upper rim 24 may define an upper portion of compartment 18. Upper rim 24 may be the location of one or more seams that attach inner layer 16 and outer layer 14 to each other (such as seam 23 as shown in FIG. 9, for example). Alternatively, upper rim 24 may not have any seams, but rather inner layer 16 and outer layer 14 may be one continuous layer. Compartment 18 is also bounded by an inner base 30 and an outer base 28. Inner base 30 may be a portion of inner layer 16, while outer base 28 may be a portion of outer layer 14. Alternatively, inner base 30 and outer base 28 may be separate pieces that are attached to inner layer 16 and outer layer 14, respectively. Inner base 30 has an opening, such as hole 20, that allows fluid communication between space 12 and compartment 18 through a valve 22 as described further below. Inner layer 16, inner base 30, outer layer 14, outer base 28, and valve 22 may be made of any suitable impermeable material, which may or may not be flexible. In some embodiments, one or more of inner layer 16, inner base 30, outer layer 14, outer base 28, and valve 22 may be made of a thin, flexible material such as plastic sheet or film which, in some embodiments, may be approximately 0.001-0.003 millimeters in thickness. Of course, one or more of inner layer 16, inner base 30, outer layer 14, outer base 28, and valve 22 may be made of material having any desired thickness. If such components are made of a sufficiently flexible material, beverage insulator 10 may be folded, rolled, crumpled, or otherwise compressed into a relatively small configuration to allow for convenient transport or storage of beverage insulator 10 when not in use. Such components may or may not be made of material that is at least partially biodegradable.

Referring again to FIGS. 1-3, prior to use, beverage insulator 10 may be substantially collapsed such that there is little or no air or other fluid in compartment 18. A user may then configure beverage insulator 10 substantially as shown in FIG. 1, except that compartment 18 may still be substantially collapsed. In some embodiments, as beverage container 26 is inserted into interior space 12 of beverage insulator 10, beverage container 26 may act like a piston and force air or other fluid from interior space 12 through hole 20 and valve 22 and into compartment 18, thus inflating compartment 18. In other embodiments described below, compartment 18 may be at least partially inflated with air or other fluid by alternative methods. The air or other fluid in compartment 18 serves to insulate beverage container 26 and its contents. Although the embodiment illustrated in FIGS. 2-3 shows hole 20 and valve 22 generally centered in the bottom of beverage insulator 10, hole 20 and valve 22 may be located in any desired location which allows hole 20, valve 22, and compartment 18 to be in fluid communication with each other. In some embodiments, valve 22 may be a one-way valve such that valve 22 allows the flow of air or other fluid into compartment 18 but substantially prevents or hinders the flow of air or other fluid out of compartment 18 into space 12. It should be noted that air or other fluid need not be completely prevented from escaping compartment 18 in order for beverage insulator 10 to be useful. For example, valve 22 may allow a slow escape of air or other liquid from compartment 18.

Figure 8:
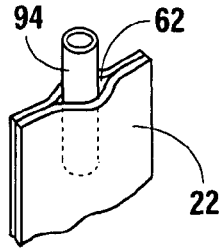
FIG. 8 is a perspective view of a portion of a valve for a beverage insulator.
Figure 12:
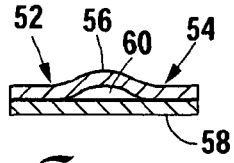
FIG. 12 is a sectional view of the valve of FIG. 11 taken in the direction of arrows 12-12 as shown in FIG. 11.
Figure 11:
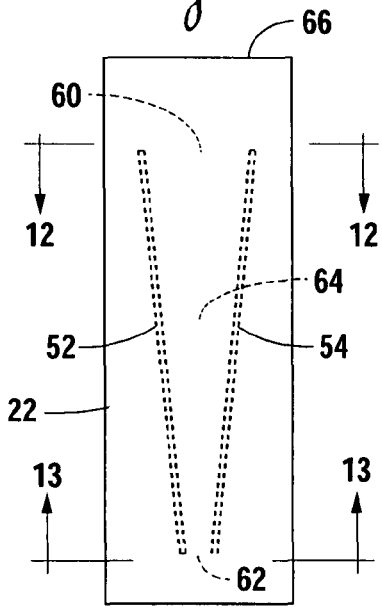
FIG. 11 is a plan view of a valve for the beverage insulator of FIG. 9.
Figure 13:
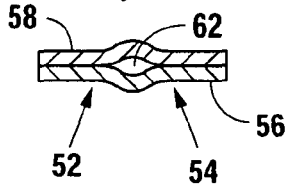
FIG. 13 is a sectional view of the valve of FIG. 11 taken along section 13-13 as shown in FIG. 11.
Figure 18:
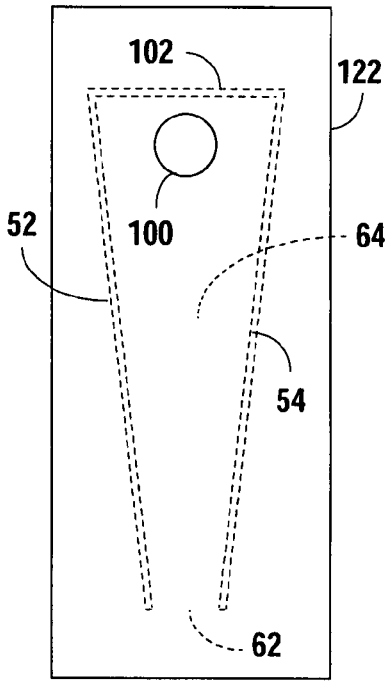
FIG. 18 is a plan view of an alternative embodiment of a valve which may be used in connection with a beverage insulator.

As illustrated in FIGS. 11-13, valve 22 may comprise two thin sheets 56 and 58 of flexible material, such as plastic, that are attached to each other with seams 52 and 54 that form a passageway 64 having openings 60 and 62 at or near respective ends of valve 22. Openings 60 and 62 are shown exaggerated in FIGS. 12 and 13, but in reality sheets 56 and 58 may lie substantially adjacent one another. Opening 60, which may or may not be larger than opening 62, is placed in fluid tight communication with hole 20 by sealing flaps 66 of valve 22 to the underside of inner base 30 as shown in FIG. 9, and opening 62 is placed in fluid communication with compartment 18. Alternatively, in an alternative valve 122 as shown in FIG. 18, the top or bottom sheet may have a hole 100 and seam 102 instead of opening 60. Hole 100 may be sized and shaped such that hole 100 may be placed in fluid communication with hole 20 on beverage insulator 10 (see FIG. 9 for example). If desired, a tube 94 may be placed in either or both of opening 60 and opening 62 as shown in FIG. 8 to help facilitate the flow of air or other fluid through passageway 64 of valve 22. Valve 22 as shown in FIGS. 8-13, or valve 122 as shown in FIG. 18, may function as a substantially one-way valve because the pressure inside compartment 18 upon inflation thereof acts on sheets 56 and 58 and substantially collapses passageway 64 once the pressurizing force is reduced or removed.

Referring now to FIG. 17A, which shows an alternative beverage insulator 90, a hole 124 may be located at any location along upper rim 24. In this embodiment, beverage container 26 being inserted into interior space 12 may not force air or other fluid into compartment 18. Air or other fluid may enter valve 22 and compartment 18 through a tube 94, such as a plastic coffee stirrer with one or more lumens, for example, which may be inserted into passageway 64 of valve 22 through hole 124 as shown by arrow 92. A user may inflate compartment 18 by blowing air or other fluid through tube 94, either before or after beverage container 26 is inserted into interior space 12. Once compartment 18 is inflated, tube 94 may be removed. FIG. 8 and FIG. 18 illustrate various embodiments of valve 22 or 122 that may be used with beverage insulator 90 in FIG. 17A or other beverage insulators described herein.

Alternatively, some embodiments may not have a valve. For example, at least a portion of one or both of inner layer 16 and inner base 30 may be made of a material that has an affinity for the material which makes up beverage container 26. When beverage container 26 is inserted into interior space 12, beverage container 26 may come into proximity with such material that has an affinity for it such that one or both of inner layer 16 and inner base 30 forms a seal with container 26 to at least partially prevent or hinder the flow of air or other fluid out of compartment 18. Once again, such an arrangement need not completely prevent air or other fluid from escaping compartment 18.

Figure 4A:
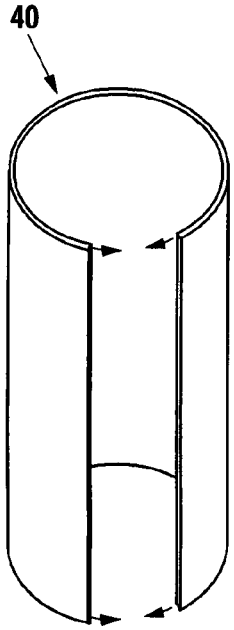
FIGS. 4A-4D are perspective schematic views illustrating a method of making an inner portion of an embodiment of a beverage insulator.
Figure 4B:
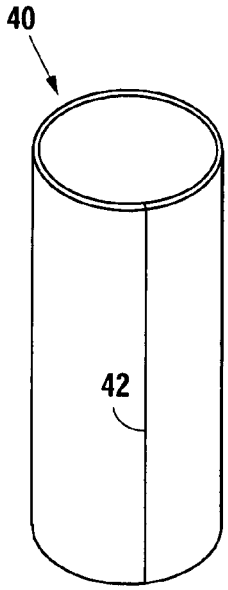
Figure 4C:
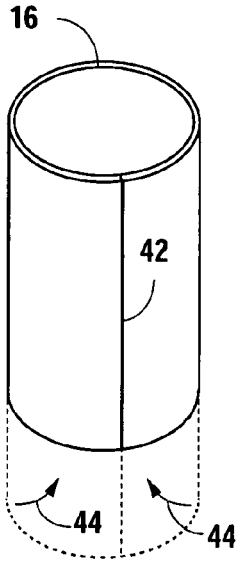
Figure 4D:
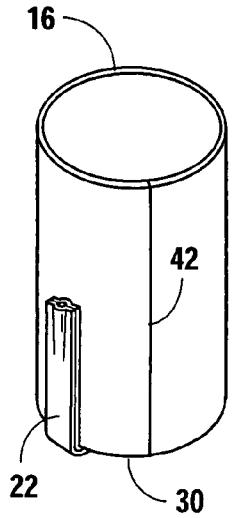
Figure 5A:
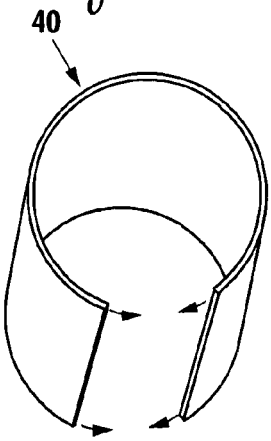
FIGS. 5A-5D are alternative perspective schematic views illustrating a method of making an inner portion of an embodiment of a beverage insulator.
Figure 5B:
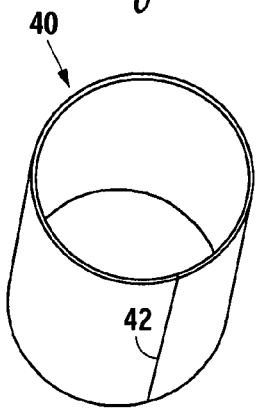
Figure 5C:
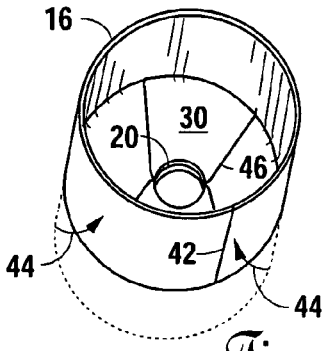
Figure 5D:
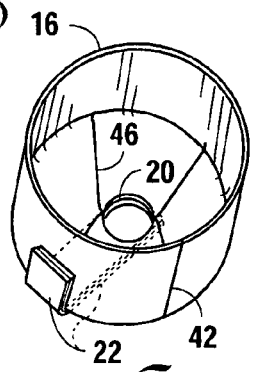
Figure 16A:
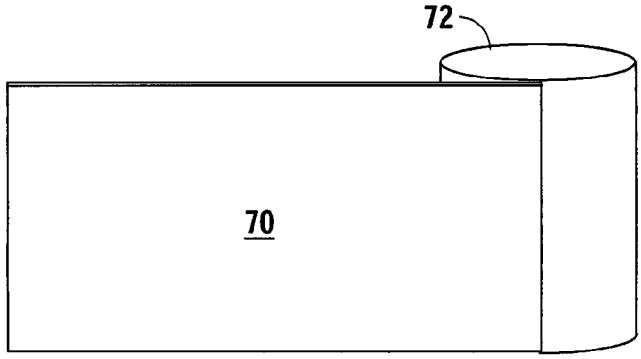
FIGS. 16A-16H are perspective schematic views illustrating a method of making an inner portion of an embodiment of a beverage insulator.
Figure 16B:
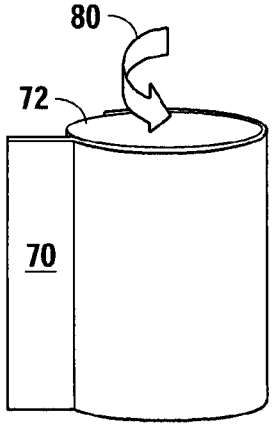
Figure 16C:
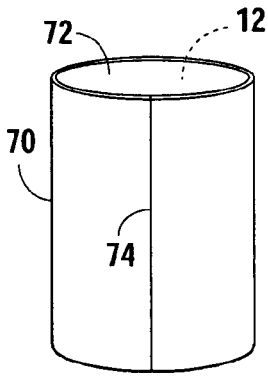

Now referring to FIGS. 4A-4D, FIGS. 5A-5D and FIGS. 16A-16H, various methods of making alternative embodiments of beverage insulator 10 are shown. Inner layer 16 in FIG. 4D and FIG. 5D may be formed from a relatively flat sheet 40, which may be rolled to form a cylinder as shown in FIG. 4A and FIG. 5A and may be connected at seam 42 as shown in FIG. 4B and FIG. 5B. Alternatively, as shown in FIGS. 16A-16C, inner layer 16 may be formed from a relatively flat sheet 70 by use of a mold 72. Sheet 70 may be rolled around mold 72 to form a cylinder by at least temporarily or partially attaching sheet 70 to mold 72, and rotating mold 72 as shown by arrow 80, or in the opposite direction of arrow 80. Sheet 70 may or may not be at least partially or temporarily attached to mold 72 and sheet 70 may be manually rolled around mold 72. Sheet 70 may be connected at seam 74 as shown in FIG. 16C. At any time during the method illustrated in FIGS. 16A-16H, mold 72 may be removed from interior space 12 of beverage insulator 10. As shown in FIG. 4C and FIG. 5C, to form inner base 30, at least a portion of sheet 40 may be folded under as shown by arrows 44 and seamed together. One or more folds 46 may be the location of one or more seams. Space may be left in inner base 30 to form hole 20, or hole 20 may be cut or otherwise formed in base 30.

Figure 16D:
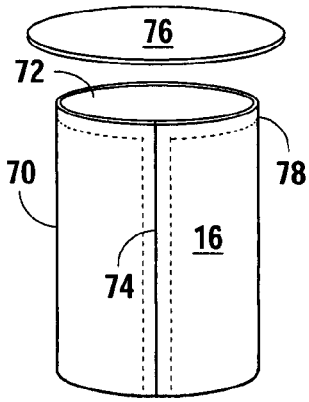
Figure 16E:
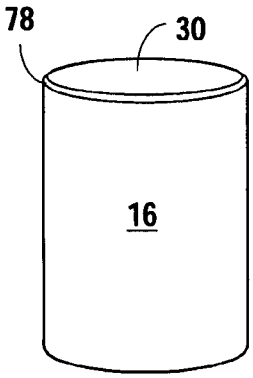
Figure 16F:
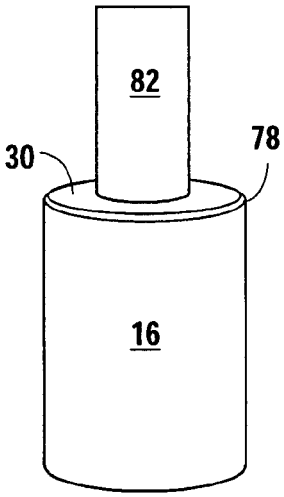
Figure 16G:
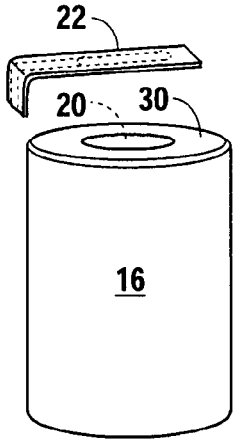
Figure 16H:
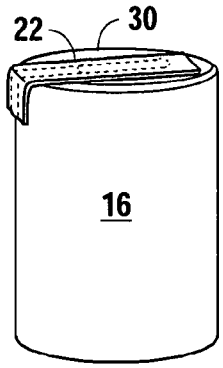
Figure 17B:
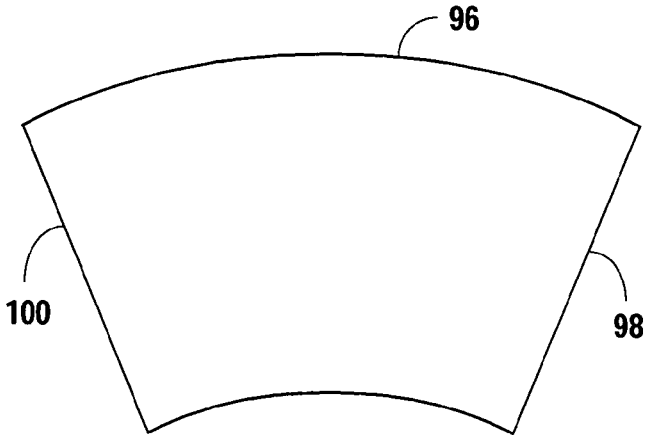
FIG. 17B is a plan view of a sheet that may be used to construct an inner portion of the beverage insulator of FIG. 17A.

Alternatively, as shown in FIGS. 16D-16E, to form inner base 30, a relatively thin flat circular bottom sheet 76 may be attached to inner layer 16. Mold 72 may serve as a guide for the correct placement of bottom sheet 76 to form inner base 30. In some embodiments, bottom sheet 76 may be folded such that at least a portion of bottom sheet 76 is in communication with at least a portion of sheet 70. Bottom sheet 76 may be attached to sheet 70 by seam 78, thus forming base 30. Hole 20 may be cut out of inner base 30 by a cutter or die 82 as shown in FIG. 16F. Alternatively, bottom sheet 76 may be pre-cut with hole 20 before bottom sheet 76 is seamed to sheet 70. Referring to FIGS. 17A-17B, the inner layer 16 of the beverage insulator 90 depicted in FIG. 17A may be constructed in a similar manner as the manner shown in FIGS. 16A-16H, except inner layer 16 may be formed from a relatively flat sheet 96 which is sized and shaped such that inner layer 16 may have a substantially conical shape when flat sheet 96 is rolled. Edge 100 and edge 98 of sheet 96 may be connected together with a seam to form inner layer 16 of the beverage insulator 90 of FIG. 17A. Inner base 30 may be formed by the same process as illustrated in FIGS. 16D-16F.

Figure 6:
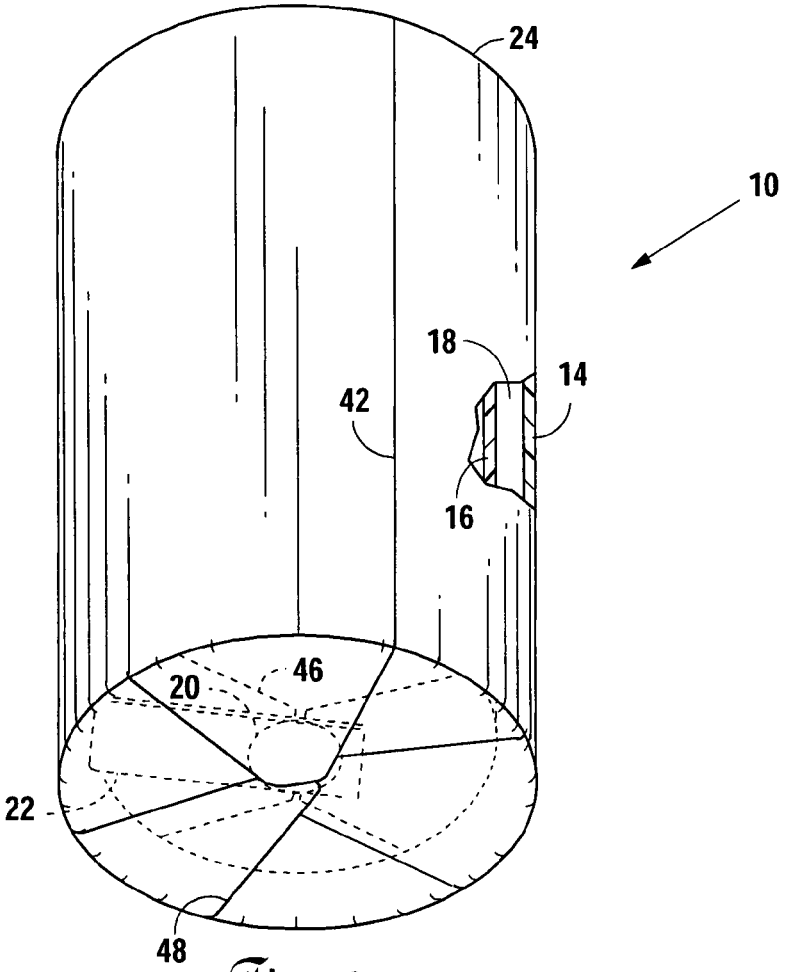
FIG. 6 is a bottom perspective schematic view of an embodiment of a beverage insulator.
Figure 7:
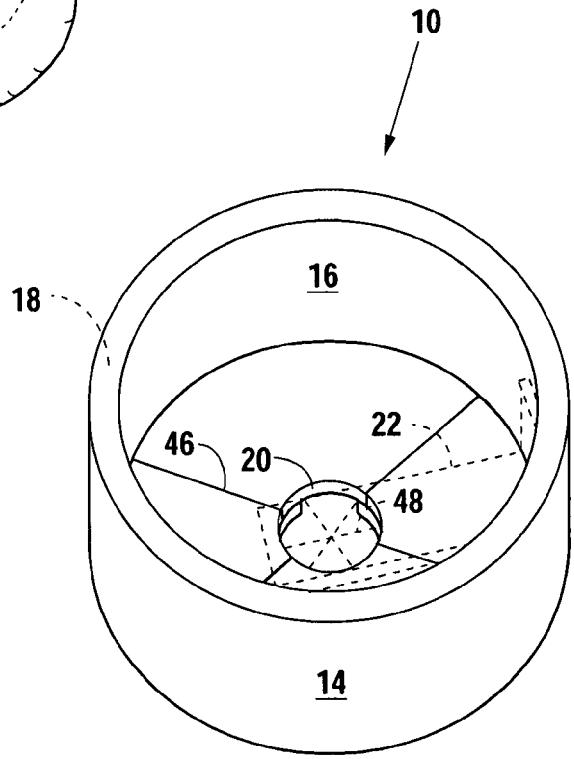
FIG. 7 is a top perspective schematic view of the beverage insulator of FIG. 6.

As shown in FIG. 4D, FIG. 5D and FIGS. 16G-16H, valve 22 or 122 may be attached to inner base 30 in fluid communication with hole 20, and further attached up on the outside of inner layer 16. The attachment of valve 22 or 122 to base 30 and inner layer 16 may be accomplished by heat welding, an adhesive or glue, or other suitable means of attachment. As shown in FIG. 6, outer layer 14 may be constructed in a similar manner as the manner shown in FIGS. 4A-4D and FIGS. 5A-5D for inner layer 16, wherein folds 48 form outer base 28, except that outer base 28 may be substantially continuous without any hole. Alternatively, outer layer 14 may be constructed in a similar manner as the manner shown in FIGS. 16A-16H, except by use of a mold having a larger size than the corresponding inner layer 16, and outer base 28 may be substantially continuous without any hole. FIG. 7 shows a top perspective view of a beverage insulator 10 constructed in the manner described in FIGS. 4A-4D and FIGS. 5A-5D.

Figure 10:
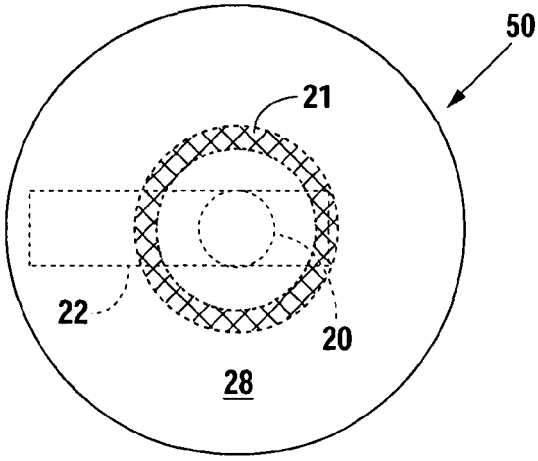
FIG. 10 is a bottom view of the beverage insulator of FIG. 9.

Now referring to FIGS. 9-10, a complete beverage insulator 50 made from the methods illustrated in FIGS. 4A-4D, FIGS. 5A-5D, or FIGS. 16A-16H is shown. Inner layer 16 and outer layer 14 may be connected at or near their top edges by a seam 23. Inner layer 16 and outer layer 14 may also be connected at their bases by a seam 21, which should not occlude valve 22. Seam 21 may be located at or near the edge of hole 20 such that seam 21 also serves to seal valve 22 to inner base 30. Although seams 23 and 21 are illustrated at the top and bottom of beverage insulator 10, respectively, suitable seams may be provided at any desirable locations on beverage insulator 10. Beverage insulator 50 may be used to insulate a beverage container 26 in like manner as described above for beverage insulator 10. Although the bottom of beverage insulator 50 is shown as being wavy and irregular, in practice it may be substantially flat if beverage insulator 50 is made of thin plastic material.

Although the foregoing specific details describe certain embodiments of this invention, persons reasonably skilled in the art will recognize that various changes may be made in the details of this invention without departing from the spirit and scope of the invention as defined in the appended claims and considering the doctrine of equivalents. Therefore, it should be understood that this invention is not to be limited to the specific details shown and described herein.

What is claimed is:

1. A beverage insulator comprising:

a generally hollow body having an interior space;

said interior space being adaptable to receive at least a portion of a beverage container;

a compartment disposed exteriorly of and in fluid communication with said interior space;

said interior space being shaped and sized complementary to the beverage container such that said compartment inflates with fluid upon insertion of the beverage container into said interior space; and a one-way valve in fluid communication with said interior space and said compartment.

2. The beverage insulator of claim 1 wherein said compartment is disposed along the periphery of said body.

3. The beverage insulator of claim 1 wherein said generally hollow body comprises a flexible material.

4. A beverage insulator comprising:

a generally hollow body having an interior space, an open upper end, a bottom, and a sidewall;

said generally hollow body comprising a flexible material;

said interior space being adaptable to receive at least a portion of a beverage container;

at least one compartment disposed laterally outboard from said sidewall and above said bottom and in fluid communication with said interior space;

said at least one compartment being bounded by an inner layer and an outer layer;

said interior space being shaped and sized complementary to the beverage container such that said at least one compartment inflates with air upon insertion of the beverage container into said interior space.

5. The beverage insulator of claim 4 further comprising a valve in fluid communication with said interior space and said compartment.

6. The beverage insulator of claim 5 wherein said valve comprises a one-way valve.

7. The beverage insulator of claim 6 wherein said one-way valve comprises a first sheet attached to a second sheet with a passageway between said first and second sheets.

8. The beverage insulator of claim 4 wherein said at least one compartment comprises a plurality of compartments.

9. The beverage insulator of claim 8 wherein two or more of said plurality of compartments are in fluid communication with each other.

10. The beverage insulator of claim 4 wherein said body comprises a graphic element.

11. The beverage insulator of claim 4 wherein said inner layer and said outer layer have substantially different shapes when said at least one compartment is inflated.

12. The beverage insulator of claim 11 wherein said inner layer comprises a substantially cylindrical shape.

13. The beverage insulator of claim 12 wherein said outer layer comprises a substantially convex shape.

14. The beverage insulator of claim 13 wherein said substantially convex shape comprises a portion of a ball shape.

15. The beverage insulator of claim 14 wherein said portion of a ball shape comprises a truncated football shape.

16. The beverage insulator of claim 14 wherein said portion of a ball shape comprises a truncated basketball shape.

17. A beverage insulator comprising:

a generally hollow body having an interior space;

said interior space being adaptable to receive at least a portion of a beverage container;

a compartment disposed exteriorly of and in fluid communication with said interior space;

said interior space being shaped and sized complementary to the beverage container such that said compartment inflates with air upon insertion of the beverage container into said interior space;

at least a portion of said hollow body comprising an affinity for at least a portion of said beverage container;

wherein said affinity is adaptable to cause the formation of a seal between said hollow body and said beverage container; and a one-way valve in fluid communication with said interior space and said compartment.

18. A beverage insulator comprising:

a generally hollow body having an interior space;

said interior space being adaptable to receive at least a portion of a beverage container;

a compartment disposed exteriorly of said interior space;

a one-way valve in fluid communication with said compartment;

said one-way valve comprising a first sheet and a second sheet sealed to said first sheet along two seams wherein said seams form a passageway therebetween;

wherein, after inflation of said compartment, said passageway substantially collapses and at least partially prevents the flow of fluid out of said compartment.

19. The beverage insulator of claim 18 wherein said one-way valve is adaptable to receive a tube to facilitate inflation of said compartment.

20. The beverage insulator of claim 18 wherein said interior space comprises a truncated cone shape adaptable for receiving a tapered beverage container.

* * * * *